US006836967B1

(12) United States Patent
Sakai

(10) Patent No.: US 6,836,967 B1
(45) Date of Patent: Jan. 4, 2005

(54) FOLDING KNIFE WITH LOCKING MECHANISM

(75) Inventor: Yoshiro Sakai, Seki (JP)

(73) Assignee: Gerber Sakai Co., Ltd., Gifu-ken (JP)

( * ) Notice: Subject to any disclaimer, the term of this patent is extended or adjusted under 35 U.S.C. 154(b) by 0 days.

(21) Appl. No.: 10/747,687

(22) Filed: Dec. 30, 2003

(51) Int. Cl.[7] ..... B26B 1/04
(52) U.S. Cl. ..... 30/161; 30/160
(58) Field of Search ..... 30/161, 160, 519, 30/155, 158, 159, 154, 153; 16/334, 335, 331, 332, 324; 7/118–120, 129, 132, 332, 324

(56) References Cited

U.S. PATENT DOCUMENTS 5,111,581 A * 5/1992 Collins ..... 30/161
5,325,588 A * 7/1994 Rogers ..... 30/161
5,737,841 A 4/1998 McHenry et al.
6,338,431 B1 * 1/2002 Onion ..... 30/161
6,370,778 B1 * 4/2002 Conable ..... 30/161
6,397,477 B1 * 6/2002 Collins ..... 30/161
6,427,335 B1 * 8/2002 Ralph ..... 30/161
6,684,510 B1 * 2/2004 Collins ..... 30/161
6,751,868 B2 * 6/2004 Glesser ..... 30/161
2004/0020058 A1 * 2/2004 Vallotton ..... 30/160

* cited by examiner

*Primary Examiner*—Allan N. Shoap
*Assistant Examiner*—Ghassem Alie
(74) *Attorney, Agent, or Firm*—Posz & Bethards, PLC

(57) ABSTRACT

A folding knife includes a handle and a blade pivotally supported on the handle. A tang of the blade includes a cam surface. The cam surface has a substantially arcuate guiding portion and an engaging portion that extends continuously from one end of the guiding portion. A notch formed on an upper edge of the handle is provided with a lock mechanism. The lock mechanism includes a guide member, which is fixed to the handle in the notch, a hollow lock tube, which is supported on the guide member, and a coil spring, which is accommodated in the lock tube. The lock tube is movable along the longitudinal direction of the handle between a lock position for engaging the engaging portion and an unlock position separated from the engaging portion. When the blade is in the open position, the coil spring moves the lock tube toward the lock position. Thus, the blade is securely locked in the open position.

20 Claims, 3 Drawing Sheets

FOLDING KNIFE WITH LOCKING MECHANISM

BACKGROUND OF THE INVENTION

The present invention relates to a folding knife equipped with a locking mechanism for locking the blade in an open position.

An ordinary folding knife includes a handle and a blade pivotally supported at the distal end of the handle. A shaft, extending in a direction orthogonal to the blade, is attached to the distal end of the handle. A tang of the blade is pivotally supported by the shaft. The blade is movable between a folded position (non-use position), in which the blade is received within a receiving groove, and an open position (use position), in which the blade extends out of the handle.

The above mentioned folding knife has a locking mechanism for locking the blade in the open position. Various mechanisms have been conventionally proposed and put to practical use as the locking mechanism. The locking mechanism must meet various requirements such as to be able to securely lock the blade, to be able to easily lock and unlock the blade, and to have a simple configuration. However, only few locking mechanisms meet all of the requirements sufficiently.

SUMMARY OF THE INVENTION

It is an object of the present invention to provide a folding knife equipped with a novel and improved locking mechanism.

To achieve the above object, the present invention provides a folding knife including a handle and a blade attached to the handle. The handle includes a notch on an upper edge thereof. The blade is pivotally movable about a pivot axis provided in the handle. The blade is movable between a folded position in which the blade is received within the handle and an open position in which the blade extends out of the handle. The blade includes a tang positioned in the handle when the blade is in the open position. A cam surface is provided on a peripheral edge of the tang. The cam surface includes a substantially arcuate guiding portion extending about the pivot axis and an engaging portion extending continuously from one end of the guiding portion. A guide member is fixed to the handle in the notch. The guide member has a guiding axis extending in a longitudinal direction of the handle. A tubular lock member is supported on the guide member and is movable along the guiding axis with respect to the guide member. The lock member includes an axis extending along the guiding axis. The lock member is movable between a lock position in which the lock member engages the engaging portion to lock the blade in the open position and an unlock position in which the lock member is separated from the engaging portion to allow the blade to move from the open position. A bias member biases the lock member in the direction from the unlock position toward the lock position. The bias member acts to move the lock member toward the lock position so as to lock the blade with respect to the handle when the blade is in the open position.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiment together with the accompanying drawings in which:

DETAILED DESCRIPTION OF THE PREFERRED EMBODIMENTS

Figure 1:
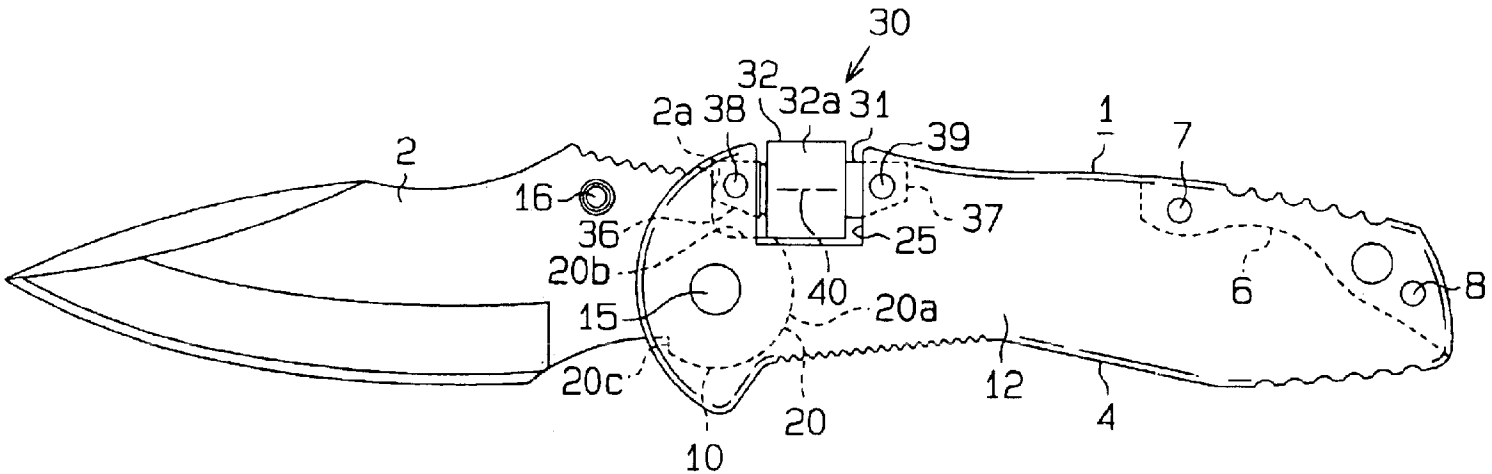
FIG. 1 is a front view of a folding knife according to one embodiment of the present invention, with the blade in an open position.

One embodiment of the present invention will now be described in accordance with FIGS. 1 to 7. As shown in FIG. 1, FIG. 2, and FIGS. 4 to 7, a folding knife includes a handle 1 and a blade 2, which is pivotally attached to the distal portion of the handle 1. The blade 2 is movable between a folded position (see FIG. 4), in which the blade is received within a receiving groove 3 of the handle 1, and an open position, (see FIG. 1 and FIG. 7) in which the blade extends out of the handle 1. The folded position corresponds to a non-use position of the blade 2 and the open position corresponds to a use position of the blade 2.

The handle 1 has first and second sidewalls 4 and 5; and a metal spacing plate 6 provided between the two sidewalls 4 and 5 in the vicinity of the basal portion of the handle 1. The two sidewalls 4 and 5 are joined together by first and second coupling pins 7 and 8 with the spacing plate 6 held in between the sidewalls 4 and 5. The first and second coupling pins 7 and 8 extend through the two sidewalls 4 and 5 and the spacing plate 6 in the vicinity of the basal portion of the handle 1. The two sidewalls 4 and 5 and the spacing plate 6 define the receiving groove 3. The first sidewall 4 has a liner plate 11 and an outer plate 12 disposed exteriorly with respect to the liner plate 11. Similarly, the second sidewall 5 has a liner plate 13 and an outer plate 14 arranged on the outer side of the liner plate 13. Both of the liner plates 11 and 13 are preferably made of a metallic material. Both of the outer plates 12 and 14 are preferably made of a synthetic resin material or wood but may also be made of a metallic material.

A blade shaft 15 extends through the two sidewalls 4 and 5 at the distal portion of the handle 1. The blade 2 includes, at the basal portion thereof, a tang 10 pivotally supported by the blade shaft 15. The axis of the blade shaft 15 is the pivot axis of the blade 2 and extends in a direction orthogonal to the handle 1 and the blade 2. The tang 10 is always arranged inside the handle 1 and held by the two liner plates 11 and 13 from both sides. A knob 16 extends from both sides of the blade 2 in the vicinity of the basal portion of the blade 2. A user may pivot the blade 2 from the folded position to the open position by operating the knob 16 with his or her fingers or by holding the part of the blade 2 exposed from the handle 1 with his or her fingers. The knob 16 may extend only from one side of the blade 2.

As shown in FIGS. 4 to 7, the peripheral edge of the tang 10 forms a cam surface 20. The cam surface 20 includes an arcuate guiding portion 20*a* extending about the axis of the blade shaft 15 and a first engaging portion 20*b* that extends continuously from one end of the guiding portion 20*a*. The first engaging portion 20*b* linearly extends from one end of the guiding portion 20*a* toward the distal end of the blade 2. The cam surface 20 further includes a second engaging portion 20*c* that extends continuously from the other end of the guiding portion 20*a*. The second engaging portion 20*c* linearly extends from the other end of the guiding portion 20*a* in a direction substantially perpendicular to the first engaging portion 20*b*.

Figure 2:
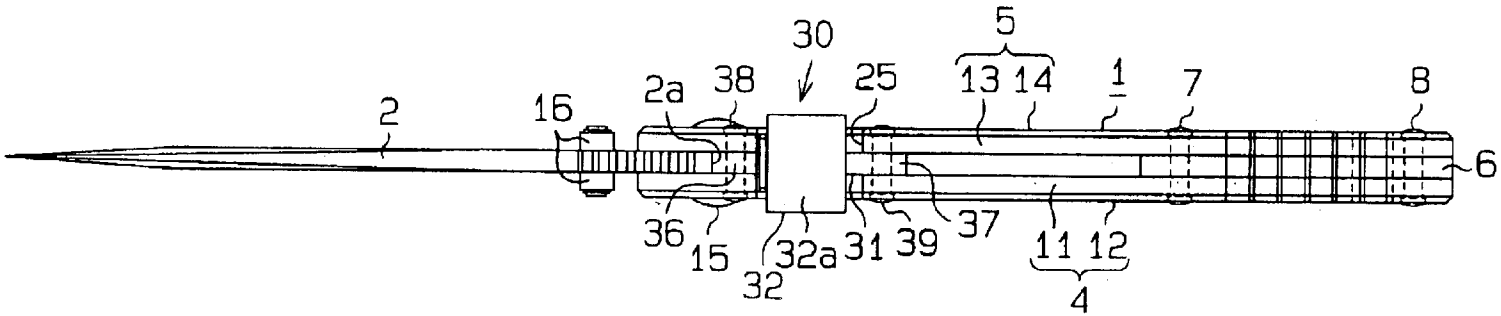
FIG. 2 is a plan view of the knife in FIG. 1.
Figure 3:
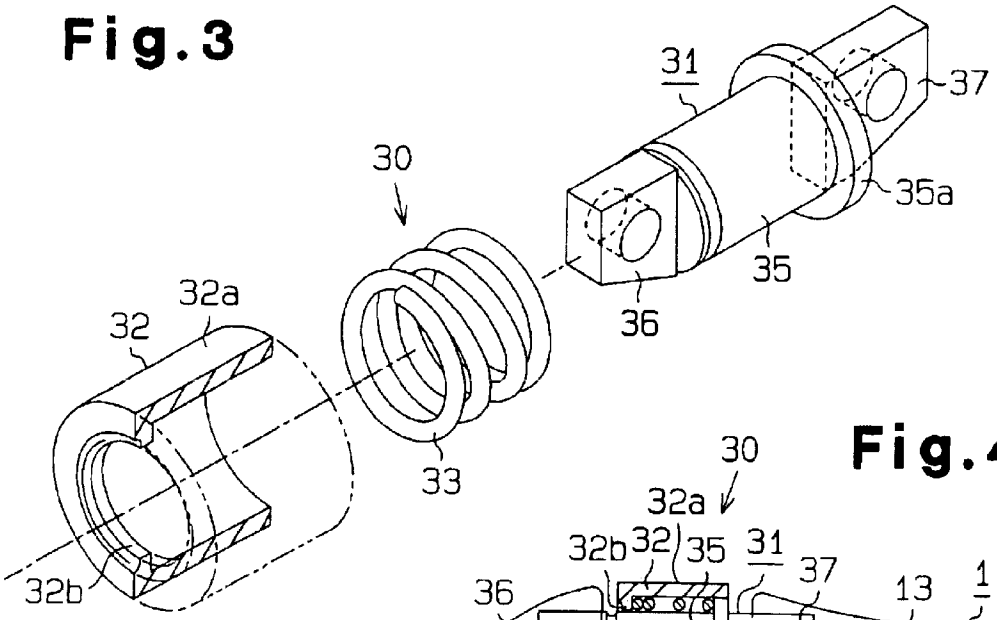
FIG. 3 is an exploded perspective view of a locking mechanism of the knife in FIG. 1.

As shown in FIGS. 1 to 3, the handle 1 has an upper edge that extends between the distal portion and the basal portion of the handle 1, with a notch 25 formed near the distal portion of the upper edge. The notch 25 is provided with a blade locking mechanism 307 which is formed as a single unit. As shown in FIG. 3, the locking mechanism 30 has a guide member 31, a hollow lock tube 32 serving as a lock member, and a coil spring 33 serving as a bias member. The guide member 31 and the lock tube 32 are preferably made of a metallic material.

As shown in FIGS. 3 to 7, the guide member 31 is fixed to the handle 1 so as to be positioned within the notch 25. The guide member 31 has a cylindrical support 35 positioned within the notch 25, and plate-like attachments 36 and 37 each extending from axial ends of the support 35. The attachments 36 and 37 are held between the two sidewalls 4 and 5 of the handle 1 and are respectively fixed to the handle 1 with corresponding coupling pins 38 and 39. The coupling pins 38 and 39 extend through the two sidewalls 4 and 5 and the corresponding attachments 36 and 37.

Of the front and rear attachments 36 and 37, the front attachment 36 functions as a stopper. In other words, in the vicinity of the basal portion of the blade 2, to be more precise, at the border of the blade portion and the tang 10 of the blade 2, an abutting portion 2*a*, which abuts against the front attachment 36, is formed, as shown in FIGS. 4 to 7. As shown in FIG. 7, when the blade 2 pivots to the open position, the abutting portion 2*a* engages the front attachment 36, thus preventing the blade 2 from pivoting further beyond the open position.

As shown in FIGS. 3 to 7, the support 35 has an axis, or a guiding axis 40, extending in a longitudinal direction of the handle 1. The guiding axis 40 lies orthogonal to the axis of the blade shaft 15.

The lock tube 32 is movably supported on the guide member 31. More specifically, the lock tube 32 is arranged encompassing the support 35 and is movable along the guiding axis 40 with respect to the support 35. Furthermore, the lock tube 32 is rotatable about the guiding axis 40 with respect to the support 35. The lock tube 32 has a cylindrical outer surface 32*a* having an axis that extends in the direction of the guiding axis 40. The diameter of the outer surface 32*a* is greater than the thickness of the handle 1, as shown in FIG. 2. The thickness of the handle 1 is the dimension of the axis of the blade shaft 15 in the direction. Thus, with respect to the axial direction of the blade shaft 15, the lock tube 32 projects outward from the outer surfaces of the handle 1. The user moves the lock tube 32 by directly operating the lock tube 32 with his or her fingers. In other words, the lock tube 32 also serves as a manual operating member.

Figure 6:
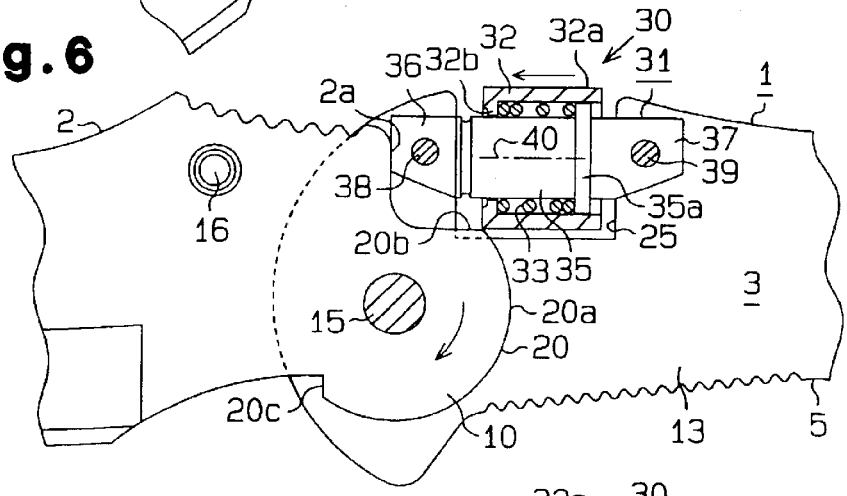
Figure 7:
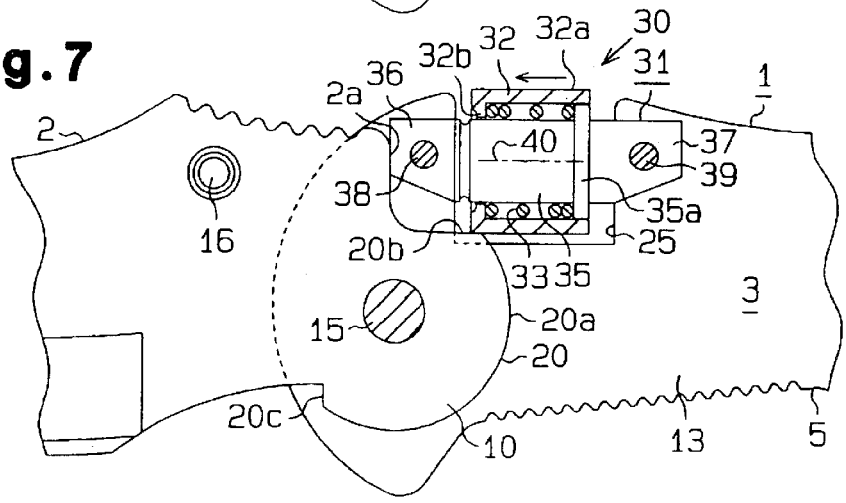

The lock tube 32 is movable between a lock position, shown in FIG. 7, and an unlock position, shown in FIG. 6, when the blade 2 is in the open position. In the lock position shown in FIG. 7, the front end of the outer surface 32*a* of the lock tube 32 engages the first engaging portion 20*b* of the tang 10, and as a result, the blade 2 is locked in the open position. In the unlock position shown in FIG. 6, the lock tube 32 disengages from the first engaging portion 20*b*, and as a result, the blade 2 is allowed to pivot from the open position to the folded position (see FIG. 4).

As shown in FIGS. 3 to 7, the coil spring 33 is arranged around the support 35 and accommodated within the lock tube 32. A flange 35*a* extends radially outward from the axially rear end of the support 35. A flange 32*b* extends radially inward from the axially front end of the lock tube 32. The flanges 35*a* and 35*b* function as spring seats, each receiving the corresponding end of the coil spring 33. The coil spring 33 biases the lock tube 32 in the direction from the unlock position to the lock position.

Figure 4:
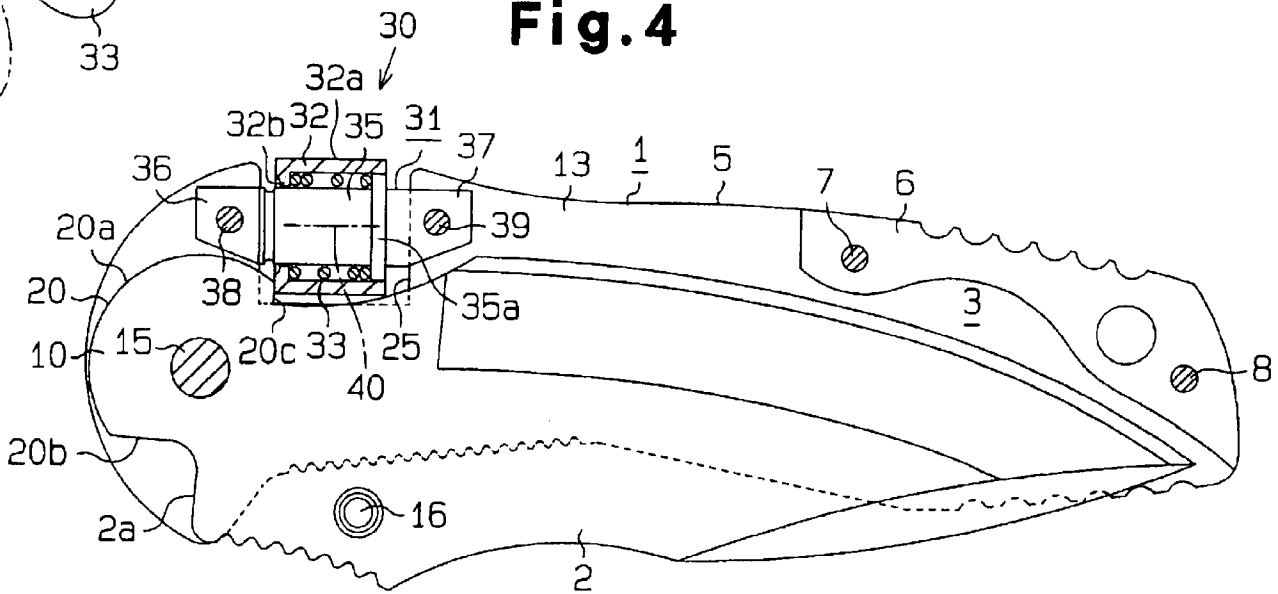
FIGS. 4 to 7 are cross sectional views sequentially describing the operations of the locking mechanism of the knife in FIG. 1.

FIG. 4 shows a state in which the blade 2 is in the folded position. In this state, the vicinity of the basal portion of the blade 2 abuts the outer surface 32*a* of the lock tube 32, preventing the blade 2 from pivoting further beyond the folded position. Furthermore, the lock tube 32 is arranged at the lock position and the front end face of the lock tube 32 engages the second engaging portion 20*c* of the tang 10. The coil spring 33 biases the lock tube 32 in the direction from the unlock position to the lock position, or toward the left in FIG. 4. Thus, the lock tube 32 pushes the second engaging portion 20*c* and applies pivoting force to the blade 2 in a counterclockwise direction in FIG. 4. Accordingly, the blade 2 is securely held in the folded position shown in FIG. 4 and does not accidentally pop out from the receiving groove 3.

When the blade 2 is pivoted from the folded position shown in FIG. 4 to the open position, the corner of the tang 10 between the guiding portion 20*a* and the second engaging portion 20*c* pushes the front end face of the lock tube 32. This moves the lock tube 32 in the direction toward the unlock position (toward the right in FIG. 4) against the bias force of the coil spring 33.

Figure 5:
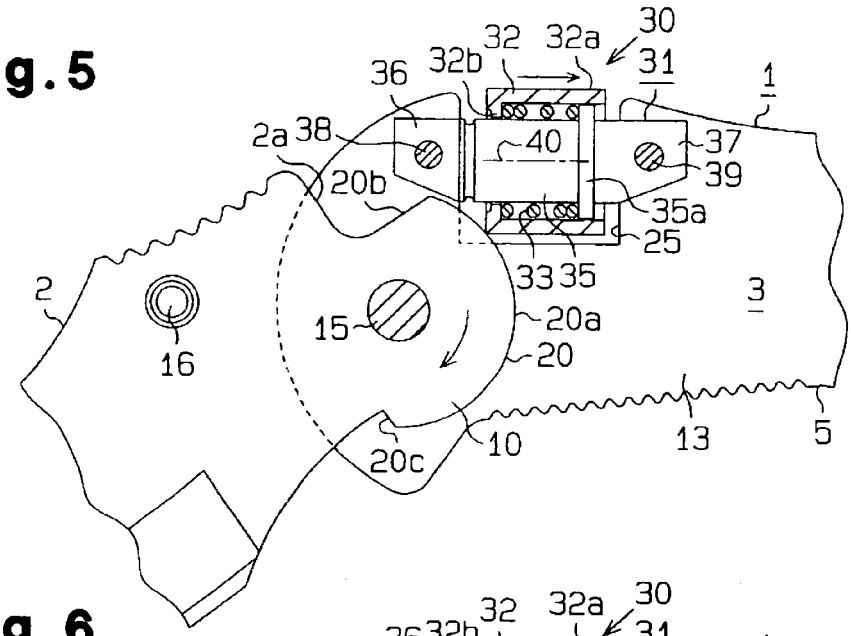

The above pivotal movement of the blade 2 and movement of the lock tube 32 separates the second engaging portion 20*c* of the tang 10 from the front end face of the lock tube 32, and the lock tube 32 rides upon the guiding portion 20*a* of the tang 10, as shown in FIG. 5. In the state shown in FIG. 5, the guiding portion 20*a* moves the lock tube 32 to the unlock position. The coil spring 33 biases the lock tube 32 so that the front end edge of the lock tube 32 is pushed against the guiding portion 20*a*. Thus, when the lock tube 32 is held in the unlock position, the blade 2 is pivoted toward the open position as the guiding portion 20*a* slidably moves along the lock tube 32. The blade 2 is stably pivoted since the lock tube 32 is pushed against the guiding portion 20*a* with an appropriate force.

Once the blade 2 is pivoted to the open position, as shown in FIG. 6, the abutting portion 2*a* of the blade 2 abuts the front attachment 36 of the guide member 31 thus preventing the blade 2 from pivoting further beyond the open position. Moreover, the guiding portion 20*a* is separated from the lock tube 32 so that the first engaging portion 20*b* of the tang 10 is flush with the outer surface 32*a* of the lock tube 32. Thus, the bias force of the coil spring 33 moves the lock tube 32 from the unlock position shown in FIG. 6 to the lock position shown in FIG. 7. In other words, the lock tube 32 is in the range of the pivot path of the tang 10. The outer surface 32*a* of the lock tube 32 engages the first engaging portion 20*b* of the tang 10 in the lock position shown in FIG. 7. Thus, the blade 2 in the open position is locked with respect to the handle 1.

In the state in which the blade 2 is in the open position, the first engaging portion 20*b* is preferably slightly inclined with respect to the guiding axis 40. In this case, the first engaging portion 20*b* is inclined toward the distal end of the blade 2 (toward the left in FIG. 7) so as to approach the guiding axis 40. When configured in such a way, the outer surface 32*a* of the lock tube 32 gradually approaches the first engaging portion 20*b* to engage with the first engaging portion 20*b* when the lock tube 32 moves from the unlock position shown in FIG. 6 to the lock position shown in FIG. 7. In other words, before the lock tube 32 reaches the lock position shown in FIG. 7, a small gap exists between the outer surface 32*a* and the first engaging portion 20*b*, and as the lock tube 32 approaches the lock position shown in FIG. 7, the gap gradually becomes smaller. The gap is eliminated when the lock tube 32 reaches the lock position in FIG. 7 and the outer surface 32*a* engages the first engaging portion 20*b*. Therefore, the lock tube 32 smoothly moves from the unlock position to the lock position. The gap between the outer surface 32*a* and the first engaging portion 20*b* is minute and not shown in the drawings.

In the state shown in FIG. 7, when force is applied to the blade 2 in the direction of the folded position (counterclockwise direction in FIG. 7), the first engaging portion 20*b* of the tang 10 is pushed against the lock tube 32, thus preventing the blade 2 from pivoting. Hence, the blade 2 is securely maintained in the locked state.

When the user moves with his or her fingers the lock tube 32 toward the unlock position against the force of the coil spring 33, the blade 2 is unlocked. In other words, when the lock tube 32 is moved manually from the lock position shown in FIG. 7 to the unlock position shown in FIG. 6, the lock tube 32 is separated from the first engaging portion 20*b*. The front end edge of the lock tube 32 is arranged in the movement path of the guiding portion 20*a* or in a position separated from such movement path. As a result, the blade 2 is allowed to pivot from the open position toward the folded position. Thus, with the lock tube 32 in the unlock position, the pivoting of the blade 2 in the counterclockwise direction of FIG. 6 pivots the blade 2 pivots to the above-described state of FIG. 5 and then to the folded position of FIG. 4.

The present embodiment described above has the following advantages.

The blade locking mechanism 30 has a simple configuration with a relatively small number of components including the guide member 31, the lock tube 32, and the coil spring 33, and its operation is also relatively simple. Thus, the manufacturing cost is reduced and there is little possibility for defects to occur in the locking mechanism 30.

The locking mechanism 30 is formed as a single unit. The folding knife provided with the locking mechanism 30 is assembled by just mounting the locking mechanism 30, unitized in advance, to the handle 1 in the notch 25 with the pair of coupling pins 38 and 39. This contributes to simplifying the assembly work and reducing the manufacturing cost, compared to when the components constituting the locking mechanism are incorporated in the handle.

The coil spring 33 biasing the lock tube 32 is accommodated within the lock tube 32. This greatly contributes to simplifying the configuration and simplifying the assembly work, compared to when the spring for biasing the lock member is provided within the handle.

When the blade 2 is in the open position, the outer surface 32*a* of the lock tube 32 engages the first engaging portion 20*b* of the cam surface 20 formed on the tang 10. The lock tube 32, biased from the unlock position toward the lock position by the force of the coil spring 33, firmly engages the first engaging portion 20*b*. Thus, the blade 2 is securely and stably locked by the locking mechanism 30, which has a simple configuration.

Even if a great force acts on the blade 2 in the locked state in the direction toward the folded position, the lock tube 32 engaged with the first engaging portion 20*b* is not separated from the first engaging portion 20*b*. The locked state of the blade 2 cannot be released unless the user moves the lock tube 32.

There is no exclusive member for manually operating the lock tube 32. When releasing the blade 2 from the lock state, the user only needs to directly and manually operate the lock tube 32. In other words, the lock tube 32 for locking the blade 2 is used also as the manual operating member. This is effective in simplifying the configuration of the locking mechanism 30.

The lock tube 32 is rotatable about the guiding axis 40. When the part of the lock tube 32 slidably contacting the cam surface 20 of the tang 10 becomes worn, the lock tube 32 may be rotated so that a part of the lock tube 32 that has not been worn, slidably contacts the cam surface 20. Thus, the high locking performance of the lock tube 32 can be stably maintained over a long period of time.

The embodiment of the present invention may also be modified as follows.

The shape of the lock tube 32 can be appropriately modified and should not be limited to the shape shown in the drawings. For example, the lock tube 32 does not necessarily have to be cylindrical and may be polygonal or conical.

It should be apparent to those skilled in the art that the present invention may be embodied in many other specific forms without departing from the spirit or scope of the invention. Therefore, the present invention is not to be limited to the details given herein, but may be modified within the scope and equivalence of the appended claims.

What is claimed is:

1. A folding knife comprising;

a handle, the handle including a notch on an upper edge thereof;

a blade attached to the handle, the blade being pivotally movable about a pivot axis provided in the handle, the blade being movable between a folded position in which the blade is received within the handle and an open position in which the blade extends out of the handle, the blade including a tang positioned in the handle when the blade is in the open position;

a cam surface provided on a peripheral edge of the tang, the cam surface including a substantially arcuate guiding portion extending about the pivot axis and an engaging portion extending continuously from one end of the guiding portion;

a guide member fixed to the handle in the notch, the guide member having a guiding axis extending in a longitudinal direction of the handle;

a tubular lock member supported on the guide member and being movable along the guiding axis with respect to the guide member, the lock member including an axis extending along the guiding axis, the lock member being movable between a lock position in which the lock member engages the engaging portion to lock the blade in the open position and an unlock position in which the lock member is separated from the engaging portion to allow the blade to move from the open position; and a bias member for biasing the lock member in the direction from the unlock position toward the lock position, the bias member acting to move the lock member toward the lock position so as to lock the blade with respect to the handle when the blade is in the open position.

2. The folding knife as claimed in claim 1, wherein the guide member, the lock member, and the bias member are assembled to form a single unit.

3. The folding knife as claimed in claim 1, wherein the lock member is rotatable about the guiding axis with respect to the guide member.

4. The folding knife as claimed in claim 1, wherein the guide member includes a cylindrical support positioned in the notch and having the guiding axis, and the lock member has a hollow cylinder shape and is arranged encompassing the support.

5. The folding knife as claimed in claim 4, wherein the bias member is a coil spring, and the coil spring is accommodated in the lock member and arranged around the support.

6. The folding knife as claimed in claim 5, wherein the support has an axial end from which a spring seat extends radially outward, and the lock member has an axial end from which a spring seat extends radially inward, the two ends of the coil spring being received by the spring seats, respectively.

7. The folding knife as claimed in claim 4, wherein the guide member includes front and rear attachments extending from the two axial ends of the support, the attachments being fixed to the handle.

8. The folding knife as claimed in claim 7, wherein the handle has a pair of sidewalls, a receiving groove for receiving the blade is formed between the two sidewalls, and the front and rear attachments are held between the two sidewalls.

9. The folding knife as claimed in claim 8, wherein the front attachment engages the blade in the open position and prevents the blade from pivoting further beyond the open position.

10. The folding knife as claimed in claim 1, wherein the engaging portion is a first engaging portion extending continuously from one end of the guiding portion, the cam surface further includes a second engaging portion provided on the other end of the guiding portion, and the bias member biases the lock member so as to engage the lock member with the second engaging portion when the blade is in the folded position to hold the blade in the folded position.

11. The folding knife as claimed in claim 1, wherein the lock member has a diameter greater than the thickness of the handle.

12. A folding knife comprising:

a handle with a pair of sidewalls, the handle including a distal portion, a basal portion, and an upper edge extending between the distal portion and the basal portion, wherein a notch is formed near the distal portion in the upper edge;

a blade shaft attached to the distal portion of the handle, the blade shaft having an axis that transverses the handle;

a blade arranged between the two sidewalls and supported by the blade shaft pivotal to the handle, the blade being movable between a folded position in which the blade is received within the handle and an open position in which the blade extends out of the handle, the blade including a tang positioned in the handle when the blade is in the open position;

a cam surface provided on a peripheral edge of the tang, the cam surface including a substantially arcuate guiding portion extending about the axis of the blade shaft and an engaging portion extending continuously from one end of the guiding portion; and a locking mechanism, the locking mechanism including:

a guide member fixed to the handle in the notch, the guide member having a guiding axis extending in a longitudinal direction of the handle, the guiding axis being orthogonal to the axis of the blade shaft;

a hollow lock tube supported on the guide member and being movable along the guiding axis with respect to the guide member, the lock tube including a cylindrical outer surface having an axis extending along the guiding axis, the lock tube being movable between a lock position in which the lock tube engages the engaging portion to lock the blade in the open position and an unlock position in which the lock tube is separated from the engaging portion to allow the blade to move from the open position, the lock tube being allowed to move between the lock position and the unlock position when the blade is in the open position, and the blade being allowed to move between the open position and the folded position, with the guiding portion facing the lock tube, when the lock tube is in the unlock position; and a coil spring received in the lock tube and arranged around the guide member, the coil spring biasing the lock tube in the direction from the unlock position toward the lock position, and the coil spring moving the lock tube toward the lock position to lock the blade to the handle when the blade is in the open position.

13. The folding knife as claimed in claim 12, wherein the locking mechanism forms a single unit.

14. The folding knife as claimed in claim 12, wherein the lock tube is rotatable about the guiding axis with respect to the guide member.

15. The folding knife as claimed in claim 12, wherein the guide member includes a cylindrical support positioned in the notch and having the guiding axis, and the lock tube is arranged encompassing the support.

16. The folding knife as claimed in claim 15, wherein the support has an axial end from which a spring seat extends radially outward, and the lock tube has an axial end from which a spring seat extends radially inward, the two ends of the coil spring being received by the spring seats, respectively.

17. The folding knife as claimed in claim 15, wherein the guide member includes front and rear attachments extending from the two axial ends of the support, the front and rear attachments being held between the sidewalls of the handle.

18. The folding knife as claimed in claim 17, wherein the front attachment engages the blade in the open position and prevents the blade from pivoting further beyond the open position.

19. The folding knife as claimed in claim 12, wherein the engaging portion is a first engaging portion extending continuously from one end of the guiding portion, the cam surface further includes a second engaging portion provided on the other end of the guiding portion, and the coil spring biases the lock tube so as to engage the lock tube with the second engaging portion when the blade is in the folded position to hold the blade in the folded position.

20. The folding knife as claimed in claim 12, wherein the outer surface of the lock tube has a diameter greater than the thickness of the handle.

* * * * *